US008737654B2

(12) United States Patent
Merks et al.

(10) Patent No.: US 8,737,654 B2
(45) Date of Patent: May 27, 2014

(54) METHODS AND APPARATUS FOR IMPROVED NOISE REDUCTION FOR HEARING ASSISTANCE DEVICES

(75) Inventors: Ivo Merks, Eden Prairie, MN (US); William S. Woods, Berkeley, CA (US); Tao Zhang, Eden Prairie, MN (US); Dominic Perz, Bloomington, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 212 days.

(21) Appl. No.: 13/081,964

(22) Filed: Apr. 7, 2011

(65) Prior Publication Data

US 2011/0249844 A1 Oct. 13, 2011

Related U.S. Application Data

(60) Provisional application No. 61/323,113, filed on Apr. 12, 2010.

(51) Int. Cl.
*H04R 25/00* (2006.01)

(52) U.S. Cl.
USPC ..... 381/317

(58) Field of Classification Search
USPC ..... 381/317
See application file for complete search history.

(56) References Cited

U.S. PATENT DOCUMENTS 4,047,264 A 9/1977 Takahashi et al.
4,627,103 A 12/1986 Fukuhara
4,628,529 A 12/1986 Borth et al.
4,630,304 A 12/1986 Borth et al.
4,811,404 A * 3/1989 Vilmur et al. ..... 381/94.3
4,852,175 A 7/1989 Kates
4,887,299 A 12/1989 Cummins et al.
5,012,519 A 4/1991 Adlersberg et al.
5,185,168 A 2/1993 Takahashi (Continued)

FOREIGN PATENT DOCUMENTS

EP 0396831 A2 11/1990
EP 0335542 B1 12/1994

(Continued)

OTHER PUBLICATIONS

Measuring and predicting quality ratings of fast-acting single microphone noise reduction, presented at the International Hearing Aid Conference (IHCON), Lake Tahoe, CA, Woods, W., Eiler, C., and Edwards, B., 2006.*

(Continued)

*Primary Examiner* — Brian Ensey
*Assistant Examiner* — Katherine Faley
(74) *Attorney, Agent, or Firm* — Schwegman, Lundberg & Woessner, P.A.

(57) ABSTRACT

Disclosed herein, among other things, are methods and apparatus for improved noise reduction for hearing assistance devices. In various embodiments, a hearing assistance device includes a microphone and a processor configured to receive signals from the microphone. The processor is configured to perform noise reduction which adjusts maximum gain reduction as a function of signal-to-noise ratio (SNR), and which reduces the strength of its maximum gain reduction for intermediate signal-to-noise ratio levels to reduce speech distortion. In various embodiments, the hearing assistance device includes a memory configured to log noise reduction data for user environments. Also provided are methods to further adjust the noise reduction based on the logged information.

20 Claims, 3 Drawing Sheets

(56) References Cited

U.S. PATENT DOCUMENTS

| | | | | |
|---|---|---|---|---|
| 5,267,322 | A | 11/1993 | Smith et al. | |
| 5,323,337 | A | 6/1994 | Wilson et al. | |
| 5,412,735 | A | 5/1995 | Engebretson et al. | |
| 5,544,250 | A | 8/1996 | Urbanski | |
| 5,550,924 | A | 8/1996 | Helf et al. | |
| 5,604,812 | A | 2/1997 | Meyer | |
| 5,687,241 | A | 11/1997 | Ludvigsen | |
| 5,884,255 | A | 3/1999 | Cox | |
| 6,175,634 | B1 | 1/2001 | Graumann | |
| 6,718,301 | B1 * | 4/2004 | Woods | 704/233 |
| 7,349,549 | B2 | 3/2008 | Bachler et al. | |
| 7,428,312 | B2 | 9/2008 | Meier et al. | |
| 7,986,790 | B2 | 7/2011 | Zhang et al. | |
| 2002/0012438 | A1 | 1/2002 | Leysieffer et al. | |
| 2002/0039426 | A1 | 4/2002 | Takemoto et al. | |
| 2003/0112988 | A1 | 6/2003 | Naylor | |
| 2004/0190739 | A1 | 9/2004 | Bachler et al. | |
| 2005/0129262 | A1 | 6/2005 | Dillon et al. | |
| 2006/0215860 | A1 | 9/2006 | Wyrsch | |
| 2007/0055505 | A1 | 3/2007 | Doclo et al. | |
| 2007/0055508 | A1 * | 3/2007 | Zhao et al. | 704/226 |
| 2007/0116308 | A1 | 5/2007 | Zurek et al. | |
| 2007/0117510 | A1 | 5/2007 | Elixmann | |
| 2007/0217620 | A1 | 9/2007 | Zhang et al. | |
| 2007/0269065 | A1 | 11/2007 | Kilsgaard | |
| 2008/0019547 | A1 | 1/2008 | Baechler | |
| 2008/0037798 | A1 | 2/2008 | Baechler et al. | |
| 2008/0107296 | A1 | 5/2008 | Bachler et al. | |
| 2008/0260190 | A1 | 10/2008 | Kidmose | |
| 2012/0155664 | A1 | 6/2012 | Zhang et al. | |

FOREIGN PATENT DOCUMENTS

| | | | |
|---|---|---|---|
| EP | 1256258 | B1 | 3/2005 |
| WO | WO-0015001 | A2 | 3/2000 |
| WO | WO-0048168 | A2 | 8/2000 |
| WO | WO-2010022456 | A1 | 3/2010 |

OTHER PUBLICATIONS

"U.S. Appl. No. 11/276,795, Advisory Action mailed Jan. 12, 2010", 13 pgs.
"U.S. Appl. No. 11/276,795, Decision on Pre-Appeal Brief Request mailed Apr. 14, 2010", 2 pgs.
"U.S. Appl. No. 11/276,795, Examiner Interview Summary filed Mar. 11, 2011", 1 pg.
"U.S. Appl. No. 11/276,795, Examiner Interview Summary mailed Feb. 9, 2011", 3 pgs.
"U.S. Appl. No. 11/276,795, Final Office Action mailed Oct. 14, 2009", 15 pgs.
"U.S. Appl. No. 11/276,795, Final Office Action mailed Nov. 24, 2010", 17 pgs.
"U.S. Appl. No. 11/276,795, Non Final Office Action mailed May 7, 2009", 13 pgs.
"U.S. Appl. No. 11/276,795, Non-Final Office Action mailed May 27, 2010", 14 pgs.
"U.S. Appl. No. 11/276,795, Notice of Allowance mailed Mar. 18, 2011", 12 pgs.
"U.S. Appl. No. 11/276,795, Pre-Appeal Brief Request mailed Feb. 16, 2010", 4 pgs.
"U.S. Appl. No. 11/276,795, Response filed Jan. 24, 2011 to Final Office Action mailed Nov. 24, 2010", 11 pgs.
"U.S. Appl. No. 11/276,795, Response filed Sep. 8, 2009 to Non-Final Office Action mailed May 7, 2009", 10 pgs.
"U.S. Appl. No. 11/276,795, Response filed Sep. 28, 2010 to Non Final Office Action mailed May 27, 2010", 6 pgs.
"U.S. Appl. No. 11/276,795, Response filed Dec. 14, 2009 to Final Office Action mailed Oct. 14, 2009", 10 pgs.
"European Application Serial No. 07250920, Extended European Search Report mailed May 11, 2007", 6 pgs.
"European Application Serial No. 11250445.1, Extended European Search Report mailed Sep. 6, 2011", 7 pgs.
Elberling, C., et al., "The Design and Testing of a Noise Reduction Algorithm Based on Spectral Subtraction", Scandinavian Audiology Supplement, 38, (1993), 39-49.
Ludvigsen, C., "Comparison of Certain Measures of Speech and Noise Level", Scandinavian Audiology, 2(1), (1992), 23-29.
Preves, David A., "Field Trial Evaluations of a Switched Directional/Omnidirectional In-the-Ear Hearing Instrument", Journal of the American Academy of Audiology, 10(5), (May 1999), 273-283.
Schwartz, Mischa, et al., "Communication Systems and Techniques", Inter-University Electronics Series, vol. 4, McGraw-Hill Book Company, (1966), p. 30-31, 36, 103.
"U.S. Appl. No. 13/189,990, Advisory Action mailed Aug. 1, 2013", 3 pgs.
"U.S. Appl. No. 13/189,990, Final Office Action mailed May 22, 2013", 15 pgs.
"U.S. Appl. No. 13/189,990, Non Final Office Action mailed Nov. 26, 2012", 12 pgs.
"U.S. Appl. No. 13/189,990, Notice of Allowance mailed Sep. 18, 2013", 15 pgs.
"U.S. Appl. No. 13/189,990, Preliminary Amendment filed Mar. 5, 2012", 37 pgs.
"U.S. Appl. No. 13/189,990, Response filed Feb. 27, 2013 to Non Final Office Action mailed Nov. 26, 2012", 8 pgs.
"U.S. Appl. No. 13/189,990, Response filed Jul. 22, 2013 to Final Office Action mailed May 22, 2013", 8 pgs.
"European Application Serial No. 11250445.1, Office Action mailed May 7, 2012", 6 pgs.
"European Application Serial No. 11250445.1, Office Action Response Filed Apr. 11, 2012", 21 pgs.
"European Application Serial No. 11250445.1, Response filed Jan. 17, 2013 to Examination Notification Art. 94(3) mailed May 7, 2012", 6 pgs.

* cited by examiner

METHODS AND APPARATUS FOR IMPROVED NOISE REDUCTION FOR HEARING ASSISTANCE DEVICES

FIELD OF THE INVENTION

The present application claims the benefit under 35 U.S.C. 119(e) of U.S. Provisional Patent Application Ser. No. 61/323,113, filed Apr. 12, 2010, which is incorporated herein by reference in its entirety.

FIELD OF THE INVENTION

The present subject matter relates generally to hearing assistance devices and in particular to methods and apparatus for improved noise reduction for hearing assistance devices.

BACKGROUND

Modern hearing assistance devices, such as hearing aids typically include a digital signal processor in communication with a microphone and receiver. Such designs are adapted to perform a great deal of processing on sounds received by the microphone. These designs can be highly programmable and may use inputs from remote devices, such as wired and wireless devices.

Numerous noise reduction approaches have been proposed. However, noise reduction algorithms can result in decreased intelligibility and audibility of speech due to speech distortion from the application of the noise reduction algorithm.

Accordingly, there is a need in the art for methods and apparatus for improved noise reduction for hearing assistance devices. Such methods should address and reduce speech distortion to enhance intelligibility and audibility of the speech.

SUMMARY

Disclosed herein, among other things, are methods and apparatus for improved noise reduction for hearing assistance devices. In various embodiments, a hearing assistance device includes a microphone and a processor configured to receive signals from the microphone. The processor is configured to perform noise reduction which adjusts maximum gain reduction as a function of signal-to-noise ratio (SNR), and which reduces the strength of its maximum gain reduction for intermediate signal-to-noise ratio levels to reduce speech distortion. In various embodiments, the hearing assistance device includes a memory configured to log noise reduction data for user environments. The processor is configured to use the logged noise reduction data to provide a recommendation to change settings of the noise reduction, in an embodiment. In various embodiments, the processor is configured to use the logged noise reduction data to automatically change settings of the noise reduction.

In various embodiments of the present subject matter, a method includes receiving signals from a hearing assistance device microphone in user environments and adjusting maximum gain reduction as a function of signal-to-noise ratio to perform noise reduction. Various embodiments of the method include reducing the strength of the maximum gain reduction for intermediate signal-to-noise ratio levels to reduce speech distortion. Also provided are methods to further adjust the noise reduction based on logged information.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

Figure 1:
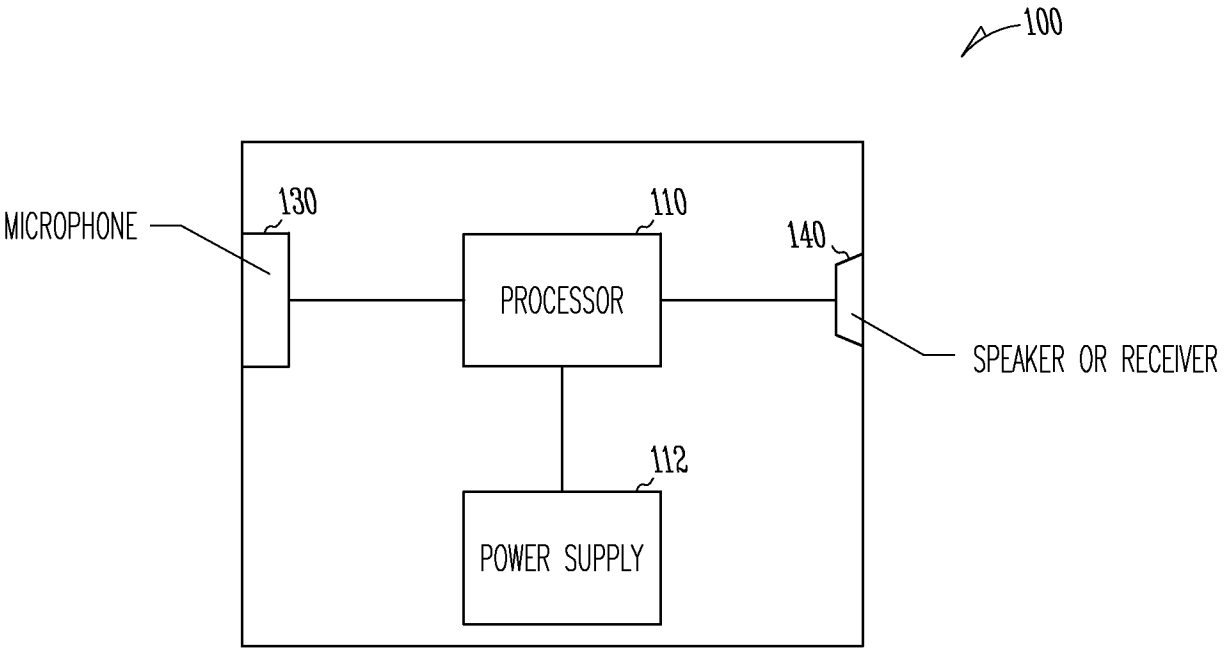
FIG. 1 shows a block diagram of a hearing assistance device according to one embodiment of the present subject matter.

FIG. 1 shows a block diagram of a hearing assistance device 100 according to one embodiment of the present subject matter. In this exemplary embodiment the hearing assistance device 100 includes a processor 110 and at least one power supply 112.

In one embodiment, the processor 110 is a digital signal processor (DSP). In one embodiment, the processor 110 is a microprocessor. In one embodiment, the processor 110 is a microcontroller. In one embodiment, the processor 110 is a combination of components. It is understood that in various embodiments, the processor 110 can be realized in a configuration of hardware or firmware, or a combination of both.

In various embodiments, the processor 110 is programmed to provide different processing functions depending on the signals sensed from the microphone 130. In hearing aid embodiments, microphone 130 is configured to provide signals to the processor 110 which are processed and played to the wearer with speaker 140 (also known as a "receiver" in the hearing aid art).

One example, which is intended to demonstrate the present subject matter, but is not intended in a limiting or exclusive sense, is that the signals from the microphone 130 are detected to determine the presence of speech. Processor 110 may take different actions depending on whether the speech is detected or not. For example, if processor 110 senses signals, but not signals of interest (for this example, speech), then processor 110 may be programmed to squelch or ignore the sounds received from the microphone until speech is detected. Processor 110 can be programmed in a plurality of modes to change operation upon detection of the signal of interest (for example, speech).

Other inputs may be used in combination with the microphone or instead of the microphone. For example, signals from a number of different signal sources can be detected using the teachings provided herein, such as audio information from a FM radio receiver, signals from a BLUETOOTH or other wireless receiver, signals from a magnetic induction source, signals from a wired audio connection, signals from a cellular phone, or signals from any other signal source. In such applications, the received signals may be squelched or ignored unless information (e.g., containing speech) is detected by processor 110. Processor 110 can be programmed to play the detected speech information exclusively to the wearer using receiver 140. Processor 110 can also be programmed to attenuate sounds detected by microphone 130 when they are deemed to be noise and not the signal of interest. In various embodiments, the amount of attenuation is programmable. When the signals from the signal source are no longer present or are not indicative of speech like sound, they can be squelched or ignored. Different attenuations, different combinations of inputs and different types of signal detection may be employed without departing from the present subject matter.

The present subject matter relates to the use of a noise reduction algorithm as a function of signal-to-noise ratio (SNR) or a metric related to SNR. Different measures of SNR are possible. For example, detection of speech-like sounds as compared to noise can be performed using the techniques described in a number of works, including, but not limited to, commonly-owned U.S. Pat. No. 6,718,301, filed Nov. 11, 1998, titled SYSTEM FOR MEASURING SPEECH CONTENT IN SOUND. The resulting figure of metric is the mean of the envelope of a signal (M) over its deviation of the envelope from the mean (D). Consequently M/D is called a Time-Varying Coefficient of Constancy (TVCC) and provides an estimate of signals of interest compared to noise. The lower M/D the better the signal-to-noise and the higher the M/D the lower the signal-to-noise.

In one embodiment, the noise reduction algorithm is a single microphone noise reduction algorithm (SMNR) (see *Measuring and predicting quality ratings of fast-acting single microphone noise reduction*, presented at the International Hearing Aid Conference (IHCON), Lake Tahoe, Calif. 2006 by Woods, W., Eiler, C., and Edwards, B., poster attached as APPENDIX A) Other noise reduction algorithms may be used without departing from the scope of the present subject matter. Noise reduction algorithms are used to improve comfort for the user in noisy environments. The drawback of these algorithms is that there is a tradeoff between noise reduction and speech distortion. Speech distortion can result in loss of audibility and intelligibility for the hearing aid users which is counterproductive for the use of a hearing aid. Furthermore hearing aid users use their hearing aid in a large range of acoustic environments and levels and a noise reduction algorithm in a hearing aid is required to work well in all those different environments. The present subject matter optimizes the use of the particular noise reduction algorithm utilized so that there will be less speech distortion and it will perform better in different environments in conjunction with other algorithms for environment detection or noise reduction. It will also optimize the algorithm depending on the environments the user encounters regularly.

Different methods can be performed using the present subject matter. For example, methods to reduce speech distortion in a noise reduction algorithm, to log data of a noise reduction algorithm, and to give recommendations or improve settings of noise reduction algorithm based on logged data are provided herein.

Method to Reduce Speech Distortion in a Noise Reduction Algorithm

One aspect of the present subject matter is to reduce the amount of speech distortion when using a noise reduction algorithm. In any noise reduction algorithm, there is always a tradeoff between noise reduction and speech distortion. The outcome of that trade off depends on the application (for example, whether the application is a cellular phone application or a hearing aid application), the type of noise (for example, car noise or noise compared to experienced at rest), and the user (for example, whether the user has normal hearing or is hearing impaired).

Figure 2:
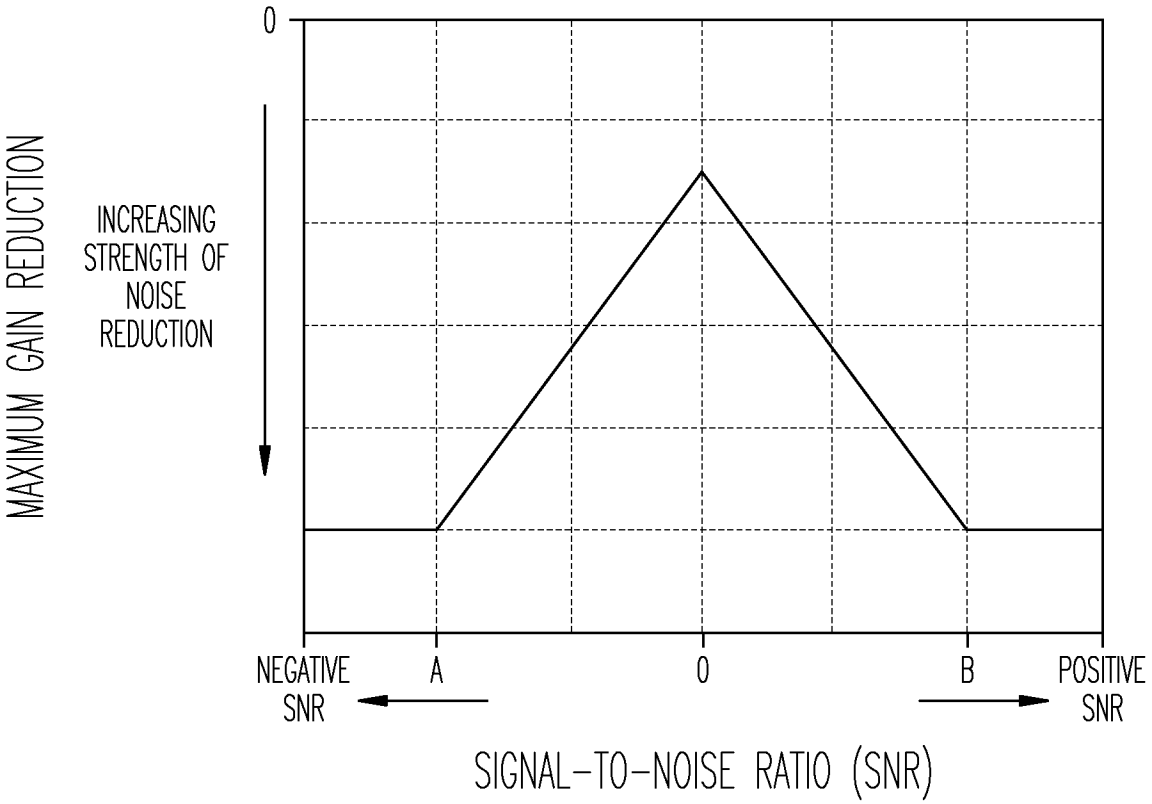
FIG. 2 shows the maximum gain reduction as a function of signal-to-noise ratio according to one embodiment of the present subject matter.

For hearing impaired users of a hearing aid, speech distortion can reduce the speech audibility or speech intelligibility which is very undesirable. The present subject matter varies the amount of noise reduction as a function of the signal-to-noise ratio (SNR). In one approach, a long term SNR is determined and used in an approach that limits the gain reduction for intermediate SNR levels. FIG. 2 demonstrates one way to adjust the level of noise reduction as a function of SNR, according to one embodiment of the present subject matter. In particular, FIG. 2 shows the maximum gain reduction as a function of SNR, according to one embodiment of the present subject matter.

In one embodiment, the gain reduction is from an SMNR algorithm and the SNR is a long term SNR, such as the Time-Varying Coefficient of Constancy (TVCC). A high TVCC corresponds to a constant signal (noise only) and a low TVCC corresponds to a very fluctuating signal (speech/music). Speech distortion will occur most at intermediate SNR levels which correspond to a TVCC (or SNR) of 0. Therefore, the maximum gain reduction is minimal (3 dB in one example) for a TVCC of 0 and it will increase to the maximum gain reduction of 10 dB for low and high TVCC values.

Figure 3:
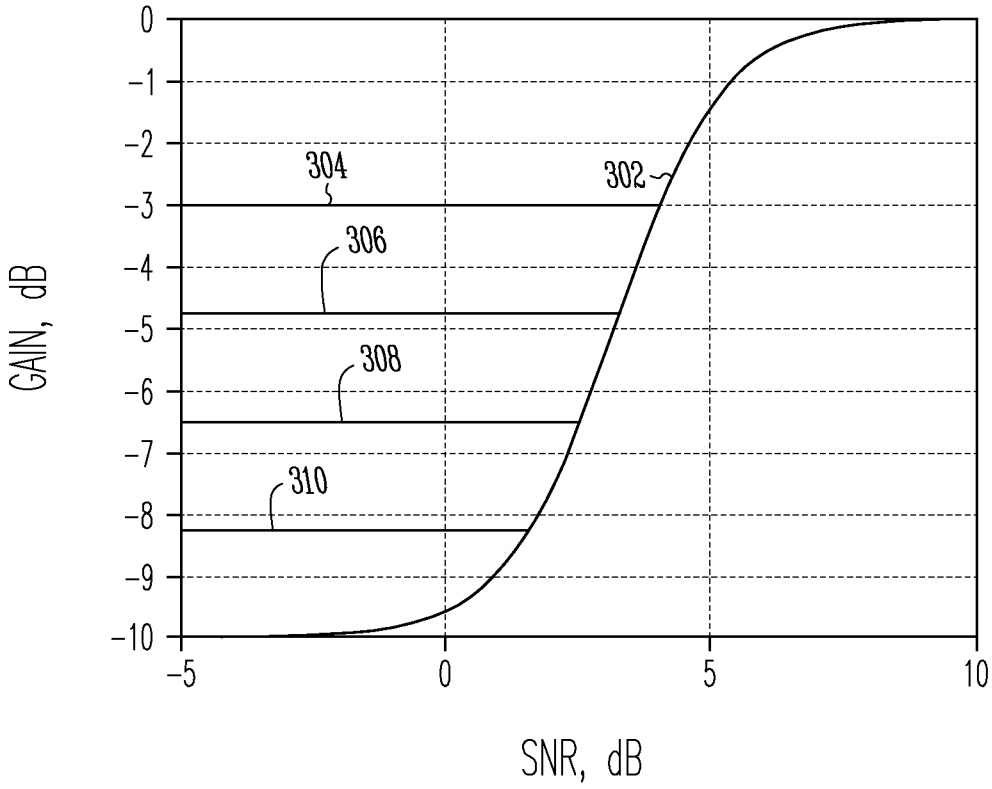
FIG. 3 shows instantaneous gain reduction as a function of signal-to-noise ratio according to one embodiment of the present subject matter.

The SNR (e.g., TVCC) determines the maximum gain reduction but the instantaneous noise reduction gain determines the actual gain reduction as is shown in FIG. 3. Thus, the instantaneous gain reduction is a function of SNR. Line 302 is the original gain function. Lines 304, 306, 308, and 310 are the gain functions limited at different maximum gain reduction values. The net effect is to reduce the amount of distortion in speech and improved speech intelligibility and audibility.

Other noise reduction algorithms may benefit from this approach, and the present disclosure is not limited to the algorithms discussed herein.

Methods to Log Data of a Noise Reduction Algorithm and to Give Recommendations or Improve Settings of Noise Reduction Algorithm Based on Logged Data One aspect of this process is to improve the working of the noise reduction algorithm by logging data during the use of the hearing aid and subsequently give recommendations to change the settings of the noise reduction algorithm or automatically change the settings of the noise reduction algorithm in run-time.

Hearing aids have the capability to log data during the use of the hearing aid. This application incorporates by reference the entire disclosure of commonly-owned U.S. application Ser. No. 11/276,795, filed Mar. 14, 2006, titled SYSTEM FOR EVALUTING HEARING ASSISTANCE DEVICE SETTINGS USING DETECTED SOUND ENVIRONMENT. One use of data logging is to log which memories have been used and how often. In one embodiment, the proposed method logs data from the noise reduction algorithm depending on the detected environment. For example, it logs the average gain reduction during speech+noise, noise-only, and specific noise environments such as machine noise or wind noise. During speech+noise, the average gain reduction during speech only and noise only will also be logged separately. Furthermore, the time and the frequency that a user spends in an environment will be logged. The logged data can be logged even when the noise reduction algorithm is disabled.

The logged data can be used in different ways, including, but not limited to the following uses. During a follow-up visit to the audiologist, the audiologist can examine the data log and compare it against the user's experiences. If the user is experiencing speech reduction and the amount of speech reduction is significant, the audiologist can choose to change the gain function. If the user is experiencing too much noise the audiologist can check whether the user is getting sufficient gain reduction or (if the noise reduction algorithm was disabled) whether the noise reduction algorithm would provide sufficient benefit for the user.

After sufficient data has been logged, the hearing aid could evaluate the data log itself and change values in the hearing aid to improve its setting. For instance, parameter settings could be changed to better balance noise reduction versus speech distortion.

Various noise reduction algorithms, including but not limited to the SMNR algorithms may be used. The logging and variable adjustment provided herein can be used to decrease speech distortion and improve speech audibility and intelligibility.

The disclosure and contents of commonly-owned U.S. Pat. No. 6,718,301, filed Nov. 11, 1998, titled SYSTEM FOR MEASURING SPEECH CONTENT IN SOUND, are hereby incorporated by reference in its entirety. This application incorporates by reference the entire disclosure of commonly-owned U.S. application Ser. No. 11/276,795, filed Mar. 14, 2006, titled SYSTEM FOR EVALUTING HEARING ASSISTANCE DEVICE SETTINGS USING DETECTED SOUND ENVIRONMENT.

The present subject matter can be used for a variety of hearing assistance devices including, but not limited to, assistive listening devices (ALDs), cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, such as receiver-in-the-canal (RIC) or receiver-in-the-ear (RITE) designs. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing assistance device, comprising:

a microphone; and a processor configured to receive signals from the microphone; and wherein the processor is configured to perform noise reduction which adjusts maximum gain reduction as a function of signal-to-noise ratio (SNR), and which reduces the strength of its maximum gain reduction for signal-to-noise ratio levels indicative of a signal of interest to reduce speech distortion, wherein the signal-to-noise ratio includes a time-varying coefficient of constancy (TVCC) to provide an estimate of the signal of interest compared to noise, and wherein the maximum gain reduction is minimized when the TVCC equals 0.

2. The device of claim 1, further comprising a memory configured to log noise reduction data for user environments.

3. The device of claim 2, wherein the processor is configured to use the logged noise reduction data to provide a recommendation to change settings of the noise reduction to decrease speech distortion and improve speech audibility and intelligibility.

4. The device of claim 2, wherein the processor is configured to use the logged noise reduction data to automatically changing settings of the noise reduction to decrease speech distortion and improve speech audibility and intelligibility.

5. The device of claim 1, wherein the maximum gain reduction is approximately 3 dB when the TVCC equals 0.

6. The device of claim 1, wherein the maximum gain reduction is increased when the TVCC is greater than or less than 0.

7. The device of claim 6, wherein the maximum gain reduction is increased to approximately 10 dB.

8. The device of claim 1, wherein the maximum gain reduction includes a single microphone noise reduction algorithm (SMNR).

9. A method, comprising:

receiving signals from a hearing assistance device microphone in user environments;

adjusting maximum gain reduction as a function of signal-to-noise ratio to perform noise reduction; and reducing the strength of the maximum gain reduction for signal-to-noise ratio levels indicative of a signal of interest to reduce speech distortion, wherein the signal-to-noise ratio includes a time-varying coefficient of constancy (TVCC) to provide an estimate of the signal of interest compared to noise, and wherein the maximum gain reduction is increased when the TVCC is greater than or less than 0.

10. The method of claim 9, farther comprising logging noise reduction data for the user environments.

11. The method of claim 10, further comprising providing a recommendation to change settings of the noise reduction based on the logged data to decrease speech distortion improve speech audibility and intelligibility.

12. The method of claim 10, further comprising automatically changing settings of the noise reduction based on the logged data to decrease speech distortion and improve speech audibility and intelligibility.

13. The method of claim 10, wherein logging noise reduction data includes logging which device memories have been used and how often the device memories have been used.

14. The method of claim 10, wherein logging noise reduction data includes logging average gain reduction during speech plus noise.

15. The method of claim 10, wherein logging noise reduction data includes logging average gain reduction during noise only.

16. The method of claim 15, wherein logging noise reduction data includes logging average gain reduction during machine noise.

17. The method of claim 15, wherein logging noise reduction data includes logging average gain reduction during wind noise.

18. The method of claim 10, wherein logging noise reduction data includes logging time and frequency that a user spends in the environments.

19. The method of claim 9, wherein the maximum gain reduction is minimized when the TVCC equals 0.

20. The method of claim 9, wherein the maximum gain reduction is approximately 3 dB when the TVCC equals 0.

* * * * *

UNITED STATES PATENT AND TRADEMARK OFFICE

CERTIFICATE OF CORRECTION

PATENT NO. : 8,737,654 B2
APPLICATION NO. : 13/081964
DATED : May 27, 2014
INVENTOR(S) : Merks et al.

It is certified that error appears in the above-identified patent and that said Letters Patent is hereby corrected as shown below:

In the Claims

Column 6, line 43, in Claim 10, delete "farther" and insert --further--, therefor Signed and Sealed this
Twenty-fifth Day of November, 2014

Michelle K. Lee

Michelle K. Lee
*Deputy Director of the United States Patent and Trademark Office*